United States Patent [19]

Dezelan

[11] 4,034,815

[45] July 12, 1977

[54] BLADE LIFT FLOAT CIRCUIT FOR MOTOR GRADERS

[75] Inventor: Joseph E. Dezelan, Joliet, Ill.

[73] Assignee: Caterpillar Tractor Co., Peoria, Ill.

[21] Appl. No.: 560,058

[22] Filed: Mar. 20, 1975

[51] Int. Cl.[2] ..... E02F 3/76; F15B 13/04; F15B 13/08

[52] U.S. Cl. ..... 172/809; 91/411 B; 91/437; 91/438

[58] Field of Search ..... 91/437, 438, 464, 411 B, 91/420; 172/809; 137/596.2

[56] References Cited

U.S. PATENT DOCUMENTS

| | | | |
|---|---|---|---|
| 2,517,164 | 8/1950 | Arps | 91/420 X |
| 2,909,342 | 10/1959 | Maltby | 91/437 X |
| 3,381,587 | 5/1968 | Parquet | 91/420 |
| 3,415,057 | 12/1968 | Rosenberg | 91/437 X |
| 3,472,127 | 10/1969 | Scheidt | 91/437 |
| 3,543,647 | 12/1970 | Hall et al. | 91/420 |
| 3,608,431 | 9/1971 | Pease | 91/437 X |
| 3,630,121 | 12/1971 | Lund et al. | 91/437 |
| 3,709,103 | 1/1973 | Dukhovny et al. | 91/437 |
| 3,730,207 | 5/1973 | Christensen | 91/437 X |
| 3,757,646 | 9/1973 | Rohner | 91/437 X |
| 3,872,670 | 3/1975 | Dezelan et al. | 60/413 |

*Primary Examiner*—Irwin C. Cohen
*Attorney, Agent, or Firm*—Phillips, Moore, Weissenberger, Lempio & Majestic

[57] ABSTRACT

A construction vehicle, such as a motor grader, comprises a work tool mounted thereon and adapted to be selectively moved by at least one double-acting hydraulic cylinder. A fluid circuit comprises a pressurized fluid source adapted to communicate fluid to the cylinder via a first control valve. A normally closed second control valve is operatively connected between a storage tank of the fluid source and the rod and head ends of the cylinder for exhausting fluid therefrom to the tank directly upon actuation of an independent actuation means. Opening of the second control valve will thus place the cylinder in a "float" condition of operation.

7 Claims, 1 Drawing Figure

BLADE LIFT FLOAT CIRCUIT FOR MOTOR GRADERS

BACKGROUND OF THE INVENTION

A conventional motor grader comprises a blade adapted to be moved and held in a selected position of operation by at least one cylinder. The cylinder is integrated into a fluid circuit, including a lockout valve adapted to trap fluid in the rod and head ends of the cylinder during such operation. The cylinder thus functions to hold the blade in a semi-rigid position on the motor grader during a finish grading operation, for example.

It is oftentimes desirable to employ the blade or other auxiliary work tool mounted on the motor grader for an additional operation, such as snow removal. During the latter operation, it is desirable to "float" the blade by providing means in the fluid circuit whereby a degree of reciprocal movement is provided by the cylinder. For example, U.S. application Ser. No. 356,362, filed on May 2, 1973 by Joseph E. Dezelan et al for "Selectively Actuatable Shock Absorbing System For An Implement Control Circuit," discloses the utilization of shock absorbing means in the form of a pair of accumulators operatively connected to the cylinder to achieve a degree of "floating." Such application, assigned to the assignee of this application, is now U.S. Pat. No. 3,872,670.

SUMMARY OF THIS INVENTION

An object of this invention is to provide an improved fluid circuit for permitting a work tool, such as the blade employed on a motor grader, to be either held in a selected work position or to be placed in a float condition of operation by at least one double-acting cylinder.

The cylinder is suitably integrated into a fluid circuit comprising a first control valve for selectively communicating a pressurized fluid source to the rod and head ends of the cylinder, a normally closed second control valve connected between the fluid source and each of the rod and head ends of the cylinder for selectively communicating fluid from the cylinder to the fluid source directly and actuation means connected between the fluid source and the second control valve for exhaust fluid from the rod and head ends of the cylinder to the fluid source directly through the second control valve.

In the preferred embodiment of this invention, a lockout valve is disposed in series between the first control valve and the rod and head ends of the cylinder of the single fluid circuit. Furthermore, a pair of such fluid circuits are preferably employed and utilize a common pressurized fluid source and a common actuation means, preferably a solenoid actuated third control valve.

BRIEF DESCRIPTION OF THE DRAWING

Other objects will become apparent from the following description and accompanying drawing which schematically illustrates a fluid circuit adapted for use on a motor grader for controlling movements of the blade thereof.

DETAILED DESCRIPTION

Figure 1:
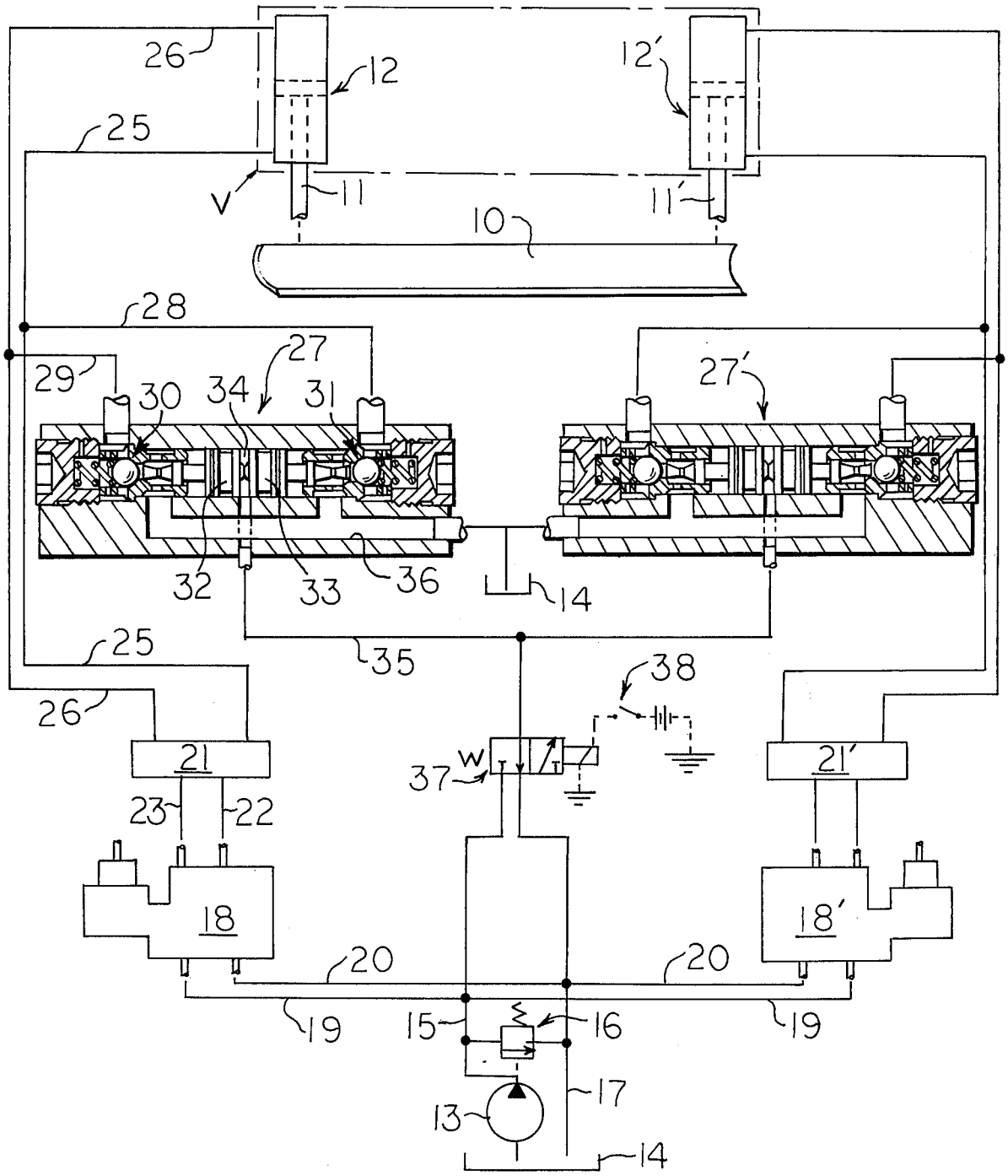

Referring to the drawing, a work tool 10, such as the blade employed on a motor grader schematically illustrated by phantom lines V, is operatively connected in a conventional manner to rods 11 and 11' of a pair of double-acting hydraulic cylinders 12 and 12', respectively. Since a number of the constructions and arrangements hereinafter described are substantially identical, they will be identified by the same numerals for brevity purposes. In addition, although the hereinafter described fluid circuit is preferably employed in conjunction with motor grader blade 10, it should be understood that the invention disclosed and claimed herein is adapted for use on other vehicles and in conjunction with other types of work tools. Furthermore, although a pair of hydraulic cylinders and attendant fluid circuits are disclosed herein, it will be seen that a single cylinder and attendant fluid circuit could be utilized, if so desired.

The fluid circuit for controlling the operation of cylinder 12, for example, comprises a pressurized fluid source including an engine-driven pump 13 adapted to draw hydraulic fluid from a tank 14 and pump it through a conduit 15. A relief valve 16 is suitably connected between conduit 15 and a return conduit 17 to relieve excessive pressures. A directional control valve or first control valve means 18 is adapted to either receive fluid from a conduit 19, connected to conduit 15, or to return exhausted fluid to tank 14 via a conduit 20 connected to conduit 17. Valve 18 is further adapted to communicate fluid to a lockout valve means 21 or to receive exhausted fluid therefrom via conduits 22 and 23 in a conventional manner.

Lockout valve means 21, functioning to selectively block communication of fluid from cylinder 12 to first control valve means 18, is operatively connected to the rod and head ends of cylinder 12 by conduits 25 and 26, respectively. The rod and head ends of the cylinder are further connected to a normally closed second control valve means 27 by conduits 28 and 29, respectively. Control valve means 27, modified as hereinafter described, is otherwise fully described in above-referenced U.S. application Ser. No. 356,362 along with valves 18 and 21, and comprises a pair of normally closed check valves 30 and 31 adapted to be opened upon the reciprocation of a pair of back-to-back pistons 32 and 33.

In particular, pressurization of an intermediate annular working chamber 34, defined between the pistons, via a conduit 35 will spread the pistons to unseat and open the check valves. The rod end of cylinder 12 will thus be placed in open communication with the head end of cylinder 12 and tank 14 to exhaust fluid thereto via conduits 25 and 28, check valve 31, and a passage 36 formed in a housing of valve means 27. Unlike the control valve means disclosed in U.S. application Ser. No. 356,362, this valve has the discharge ports interconnected within the valve body to form passage 36. Likewise, the head end of the cylinder will be placed in open communication with the rod end of cylinder 12 and the tank 14 via conduits 26 and 29, check valve 30, and passage 36. Passage 26 handles flows to and from the tank 14 equal to the cylinder rod volume.

Pressurized fluid is selectively directed to working chamber 34 from the pressurized fluid source through actuation means preferably comprising a two-position directional control valve or third control valve means 37. Such valve means is preferably spring-biased to its illustrated closed position and solenoid actuated by closing an electrical switch means 38 to move the valve spool thereof leftwardly in the drawing to communicate conduit 15 with conduit 35. The ends of cylinder 12 will thus communicate with each other and with tank 14 directly. Blade 10 is thus placed in a float condition of operation whereby it is adapted to ride over uneven terrain during a snow plowing operation, for example.

When the switch means is in its illustrated open position, pressurized fluid from pump 13 is blocked by valve means 37 and chamber 34 is opened to tank 14. Thus, spring-biased check valves 30 and 31 will close automatically to also block conduits 28 and 29. Valve means 18 and 21 may thus be actuated independently to place blade 10 in a semi-rigid position for a final grading operation, for example.

It should be noted that the fluid source, first control valve means 18, lockout valve means 21, and cylinder 12 are sequentially connected together in series to form a first sub-circuit. A second sub-circuit, also sequentially connected together in series and disposed in parallel relationship relative to the first sub-circuit, is formed by the fluid source, third control valve means 37 and second control valve means 27. The fluid source is preferably common to both of the sub-circuits. p The fluid circuit for conditioning cylinder 12' for its "float" or final grading operation, for example, is a substantial mirror image of the aforedescribed fluid circuit, as indicated by identical and primed (') numerals depicting the same. Thus, a pair of substantially identical fluid circuits, each comprising a cylinder, first and second control valve means and a lockout valve means, are provided for the operation of blade 10. The fluid source and third control valve means 37 are common to each of the circuits.

I claim:

1. In a vehicle of the type having a work tool mounted thereon, at least one double acting cylinder, means connecting said cylinder to said work tool for selectively moving the same; a fluid circuit comprising:

a fluid source;

means for pressurizing said fluid;

first control valve means for selectively communicating fluid from said means for pressurizing fluid via first passage means to rod and head ends of said cylinder;

normally closed second control valve means including a housing defining bore, a pair of check valves mounted in said bore and each operatively connected via second passage means to said first passage means and normally blocking communication from a respective rod or head end of said cylinder, a pair of back-to-back pistons reciprocally mounted in said bore and defining with said bore a working chamber therebetween, said housing further defining a sole internal passage means directly communicating each of said check valves one to the other for receiving fluid therefrom upon opening thereof and further directly communicating with said fluid source; and, third control valve means comprising a two position directional control valve movable between a normally closed position communicating said working chamber with said fluid source and an open position communicating pressurized fluid from said means for pressurizing fluid to said working chamber for urging said back-to-back pistons apart to directly interconnect said rod end of said cylinder, said head end of said cylinder and said fluid source.

2. The vehicle of claim 1 further comprising means for connecting said fluid source, said means for pressurizing fluid, said first control valve means and said cylinder together in series to form a first sub-circuit.

3. The vehicle of claim 2 further comprising means for connecting said fluid source, said means for pressurizing fluid, said third control valve means and said second control valve means together in series to form a second sub-circuit in parallel relationship relative to said first sub-circuit with said fluid source and means for pressurizing fluid being common to each of said first and second sub-circuits.

4. The vehicle of claim 1 wherein said directional control valve is solenoid actuated and spring biased to its normally closed position.

5. The vehicle of claim 4 further comprising electrical switch means operatively connected to said directional control valve for selectively moving it to its open position.

6. The vehicle of claim 1 comprising a pair of said fluid circuits and wherein each of said circuits comprises a said cylinder, a said first and second control valve means and wherein said pressurized fluid source and said third control valve means are common to each of said circuits.

7. The vehicle of claim 1 comprising a pair of said fluid circuits and wherein each of said circuits comprises a said cylinder, a said first and second control valve means and a lockout valve means operatively connected between said first control valve means and said cylinder for selectively blocking communication of fluid from said cylinder means to said first control valve means and wherein said pressurized fluid source and said third control valve means are common to each of said circuits.

* * * * *